United States Patent [19]

Klapp et al.

[11] Patent Number: 5,052,965

[45] Date of Patent: Oct. 1, 1991

[54] FLOATING RECLINER AND METHOD THEREFOR

[76] Inventors: Bruce E. Klapp; Louanna K. Klapp, both of 3107 Mescalero Dr., Lake Havasu City, Ariz. 86403

[21] Appl. No.: 454,424

[22] Filed: Dec. 21, 1989

[51] Int. Cl.[5] ..... B63C 9/08

[52] U.S. Cl. ..... 441/130; 5/420; 5/465

[58] Field of Search ..... 441/127-130, 441/136; 5/353, 420, 465

[56] References Cited

U.S. PATENT DOCUMENTS 2,623,574 12/1952 Damsch ..... 441/129
4,275,473 6/1981 Poirier ..... 441/128

FOREIGN PATENT DOCUMENTS 1176061 4/1959 France ..... 441/129
1106558 3/1968 United Kingdom ..... 441/129

*Primary Examiner*—Jesûs D. Sotelo
*Attorney, Agent, or Firm*—Harry M. Weiss

[57] ABSTRACT

A recreational, floating recliner which allows the user to sit upright, lay horizontal or recline in any position therebetween, atop the surface of any water body. The recliner is preferably comprised of a single sheet of waterproof material folded over and cut into the shape of a chair so that, like a chair, the recliner has a head section, back section, a seat section and two arm sections. Each of these sections is filled with a buoyant material, such as closed cell polyethylene, so that the recliner with the user thereon has a positive buoyancy on the water body surface.

8 Claims, 1 Drawing Sheet

FLOATING RECLINER AND METHOD THEREFOR

BACKGROUND OF THE INVENTION

1. Field of Invention

This invention relates generally to a recreational, flotation device and method therefor and, in particular, to a floating recliner that allows the user to sit upright or to lean back to any desired position including the horizontal position.

2. Description of the Prior Art

The prior art discloses a number of floating chairs and lounges. For example, Schneider et al., U.S. Pat. No. 4,662,852, Hoy Jr., U.S. Pat. No. 4,384,857 Delano, U.S Pat. No. 3,984,888 and Mosely, U.S. Pat. No. 2,803,839. However, each of these references discloses a device comprised of a conventional chair or recliner coupled to a floatation mechanism.

Therefore, there is a need for a simple, inexpensive floating recliner wherein the recliner is constructed from a single sheet of material folded over and filled with buoyant material thereby eliminating the need for a conventional chair or recliner and allowing the user to either sit upright or to recline all the way to the horizontal position.

SUMMARY OF THE INVENTION

An object of the present invention is to provide a floating recliner and method therefor that allows the user to sit upright, lay horizontal or recline in any position therebetween, atop the surface of any water body.

Another object of the present invention is to provide a floating recliner and method therefor that is constructed from a single sheet of waterproof material folded over and cut into the shape of a chair and filled with buoyant material, thereby eliminating the need for a conventional chair or recliner.

Yet another object of this invention is to provide a floating recliner and method therefor that is simple, inexpensive and easily transportable.

These and other objectives, features and advantages of the present invention, as well as details of the preferred embodiment thereof, will be more fully understood from the following description and drawing.

DESCRIPTION OF THE PREFERRED EMBODIMENT

Figure 1:
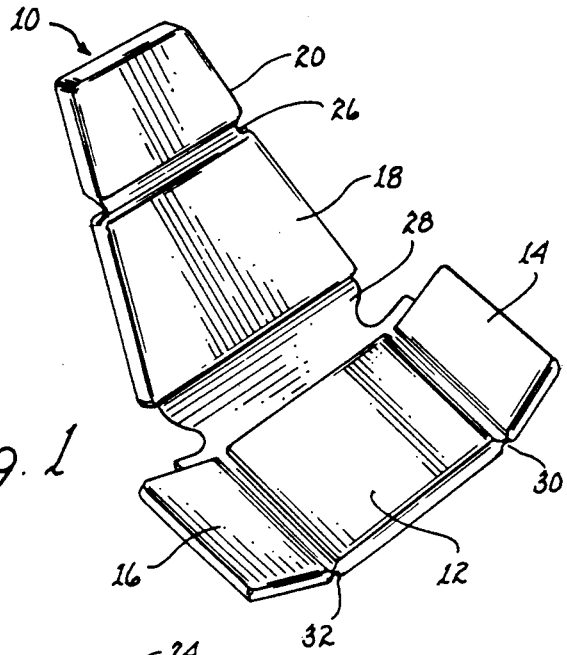
FIG. 1 is a perspective view of the floating recliner of the present invention.
Figure 4:
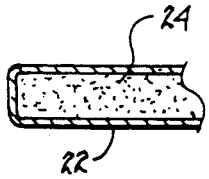
FIG. 4 is a cross-sectional view taken along line 4—4 in FIG. 2.
Figure 2:
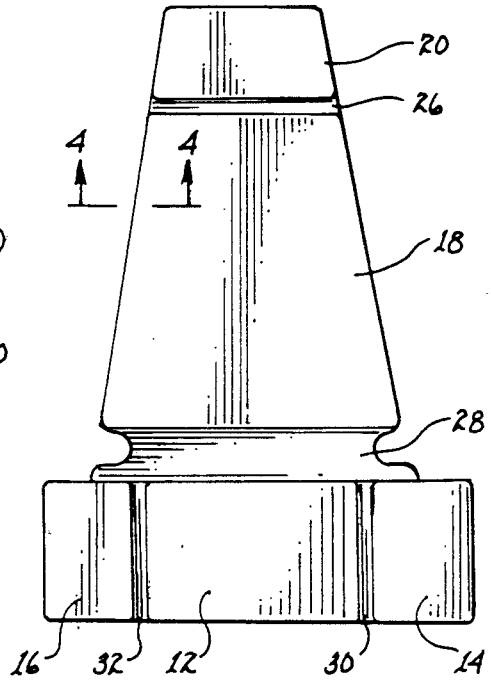
FIG. 2 is a top view of the present invention of FIG. 1.
Figure 3:
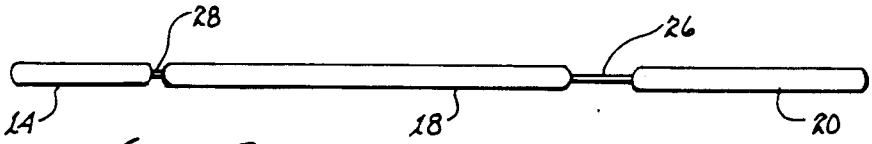
FIG. 3 is a side view of the present invention of FIG. 1.

Referring to the drawings, FIG. 1 shows a floating recliner of the present invention generally designated by number 10. In the preferred embodiment, the floating recliner 10 is comprised of a seat section 12, a left arm section 14, a right arm section 16, a back section 18 and a head section 20 (also see FIG. 2). Each of the sections 12, 14, 16, 18 and 20 are preferably formed from a casing 22 filled with buoyant material 24 (see FIG. 4). The casing 22 is preferably made from a single sheet of waterproof material, preferably nylon, which is folded over and then cut into the shape of a chair. The two halves of the casing 22 are then sewn together. As the casing 22 is being sewn, each of the sections 12, 14, 16, 18 and 20 is filled with the buoyant material 24 and then sealed by stitching. Each of the sections 12, 14, 16, 18 and 20 is separated from adjacent sections by connecting portions 26, 28, 30 and 32 which are not filled with the buoyant material 24. The buoyant material 24 has a density sufficiently less than the density of water so that the recliner 10, with a person thereon, has a positive buoyancy and will float in both fresh and salt: water. Preferably, the buoyant material 24 is fabricated from closed cell polyethylene with a thickness of about one inch. As one skilled in the art would know, other materials having a density less than water could also be used as the buoyant material 24. For example, the casing 22 could contain pockets of air or a gel material.

Figure 5:
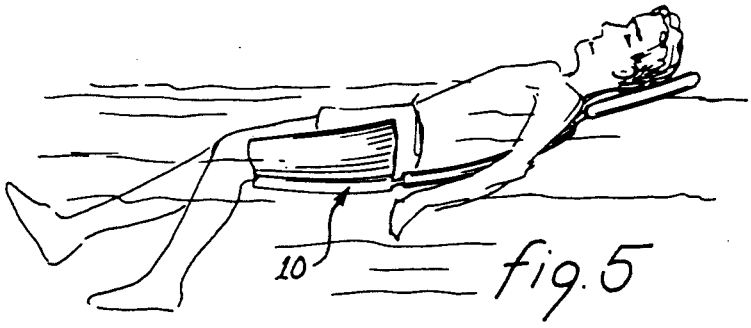
FIG. 5 shows the floating recliner of the present invention of FIG. 1 reclined in a horizontal position and showing a person thereon.
Figure 6:
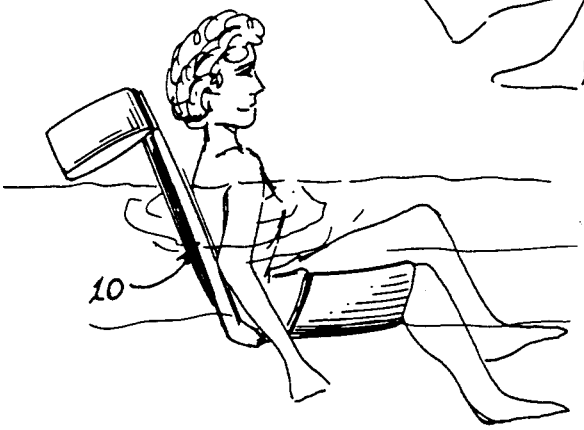
FIG. 6 shows the floating recliner of the present invention of FIG. 1 positioned in an upright position and showing a person thereon.

In operation, the recliner can be used to permit a person to lie horizontally in the water as shown in FIG. 5. Starting from the horizontal position, the user, by shifting his/her weight backward in the seat section 12, forces the back section 18 to rise. The user can stop the rise of the back section at any position by simply halting the shifting of the user's weight or the user can continue to shift his or her weight until it reaches the upright position shown in FIG. 6. Because the connecting portions 26, 28, 30 and 32 are disposed between the sections 12, 14, 16, 18 and 20, the recliner 10 is easily folded up for storage.

While the invention has been particularly shown and described with reference to a preferred embodiment thereof, it will be understood by those skilled in the art that changes in form and detail may be made therein without departing from the spirit and the scope of the invention.

I claim:

1. A floating recliner comprising:

at least one continuous sheet of waterproof material configured into said recliner;

buoyant material means encompassed by said continuous sheet of waterproof material for supporting a user in any desired position on the surface of a body of water; said continuous sheet of waterproof material is folded over and cut in the shape of a chair, said sheet having a perimeter portion and sealed along said perimeter portion forming a cavity therein, said cavity being divided into at least three sections, and said buoyant material means filling each of said three sections; said three sections are a seat section supporting said user's buttocks; a back section disposed above said seat section supporting said user's back and a head support section; said back section and head section including sides converging away from said seat section and a section of said folded over waterproof material devoid of any buoyant material located between said seat section and said back support section for supporting said user's buttocks to permit said user to use said floating recliner as a floating chair.

2. The floating recliner recited in claim 1, further comprising a left side and a right side section filled with said buoyant material means and extending sideways from opposite sides of said seat section.

3. The floating recliner recited in claim 2, further comprising a plurality of connecting portion means, not filled with buoyant material, disposed between said seat section, said side sections, and between said back section and said head section for allowing the folding of said sections over each other.

4. The floating recliner recited in claim 1 wherein said waterproof material is nylon.

5. The floating recliner recited in claim 1 wherein said buoyant material means has a density sufficiently less than the density of water thereby imparting a positive buoyancy to said recliner having said user thereon.

6. The floating recliner recited in claim 5 wherein said buoyant material means is closed cell polyethylene.

7. The floating recliner recited in claim 6 wherein said closed cell polyethylene has a thickness of about one inch.

8. The floating recliner recited in claim 5 wherein said buoyant material means is air.

* * * * *